US006708588B2

(12) United States Patent
Kesinger et al.

(10) Patent No.: US 6,708,588 B2
(45) Date of Patent: Mar. 23, 2004

(54) SELF ADJUSTING MECHANISM FOR LOCKING PLIER, WRENCH, OR OTHER TOOL

(76) Inventors: Donald A. Kesinger, 279 W. Jamison Cir. #56, LIttleton, CO (US) 80120; Eric S. Kesinger, 468 S. Balsam St., Lakewood, CO (US) 80229

( * ) Notice: Subject to any disclaimer, the term of this patent is extended or adjusted under 35 U.S.C. 154(b) by 115 days.

(21) Appl. No.: 10/295,117

(22) Filed: Nov. 15, 2002

(65) Prior Publication Data

US 2004/0000221 A1 Jan. 1, 2004

Related U.S. Application Data

(60) Provisional application No. 60/418,107, filed on Oct. 11, 2002, and provisional application No. 60/391,426, filed on Jun. 26, 2002.

(51) Int. Cl.[7] ..... B25B 7/12
(52) U.S. Cl. ..... 81/380; 81/370
(58) Field of Search ..... 81/367, 370, 377–380

(56) References Cited

U.S. PATENT DOCUMENTS

| | | | | |
|---|---|---|---|---|
| 2,499,201 A | | 2/1950 | Thayer | |
| 2,531,285 A | | 11/1950 | Manspeaker | |
| 3,104,571 A | | 9/1963 | Trybus | |
| 3,262,343 A | * | 7/1966 | Weller | 81/370 |
| RE26,280 E | | 10/1967 | Hostetter | |
| 3,600,986 A | | 8/1971 | Baldwin | |
| 4,407,493 A | | 10/1983 | Okolischan | |
| 4,499,797 A | | 2/1985 | Wilson | |
| 5,469,765 A | | 11/1995 | Franklin | |
| 6,408,724 B1 | | 6/2002 | Whiteford | |

* cited by examiner

*Primary Examiner*—James G. Smith
(74) *Attorney, Agent, or Firm*—Thomas W. Hanson

(57) ABSTRACT

A self adjusting closure mechanism for a locking plier or similar device. Central to the invention is a set of one or more friction pawls which slide along a support rod, moved by a push link working against a spring. The push link is free to rotate between two positions relative to the rod as it slides. In the first position, and in between the positions, the push link bears against the center of the friction pawls and they remain free to slide along the rod. When the push link rotates to the second position, it presses on the edge of the pawls, causing them to tilt, coupling to the rod and preventing movement along the rod. In a typical locking plier, the support rod is mounted to the frame and the opposite end of the push link connects to the handle. As the handle closes, the push link rotates towards its second position and optionally slides along the support rod. When the friction pawls lock, the plier begins to grip and lock on to the work piece. An adjustment mechanism, preferably in the form of a circular ramp interposed between the push link and the pawls, varies the relative angle of the push link where contact is made with the pawls, providing a method of adjusting the grip force of the plier. Preferably this ramp rotates along with the support rod so that turning the rod, by means of a readily accessible knob, alters the grip force of the plier. The starting position of the push link may also be adjustable, varying the width of the plier jaws in their normally open position.

15 Claims, 10 Drawing Sheets

SELF ADJUSTING MECHANISM FOR LOCKING PLIER, WRENCH, OR OTHER TOOL

CROSS-REFERENCE TO RELATED APPLICATIONS

This application claims the benefit of U.S. Provisional Applications no. 60/391,426 filed Jun. 26, 2002, and No. 60/418,107 filed Oct. 11, 2002.

STATEMENT REGARDING FEDERALLY SPONSORED RESEARCH OR DEVELOPMENT

Not Applicable

BACKGROUND OF THE INVENTION

1. Field of the invention

The present invention relates to the field of self adjusting tools and specifically to locking pliers, wrenches, or vises which self adjust to the size of the work piece.

2. Background Information

Locking pliers are well known in the industry and are exemplified by the Vise Grip® line of pliers. This type of tool offers significant advantage over conventional pliers in that it can be locked on to a work piece by squeezing the handles together until they over-center slightly, locking in position, the plier and work piece can then be manipulated without exerting any additional effort to keep the pliers closed. An adjustment screw adjusts the plier to fit a range of work piece sizes.

One major disadvantage to known locking pliers it that the adjusting screw, while effective, is slow to manipulate. The full range of adjustment may be as much as one inch or more and requires many turns of the adjusting screw to accomplish. The time required to perform this operation can be frustrating to the user. In addition, it is nearly impossible to make this adjustment one handed, requiring one hand to hold the plier while the other turns the adjusting screw.

A plier which automatically adjusts to the size of the work piece would be significantly more convenient to use. Such pliers exist, but typically have their own drawbacks. One such is the Sears Autolock Plier, marketed by Sears, Roebuck, and Co., and described in U.S. Pat. No. 3,600,986. In this plier, the adjusting knob for varying the grip force is positioned in the center of the tool, between the handles. This location is difficult to access, the knob is relatively small, and turns in the opposite direction from what would be expected. The result is a plier which provides less than satisfactory performance.

There is a need for a locking plier which self adjusts to the size of the work piece. The grip force should be easily and conveniently adjustable by the user, preferably in a conventional manner and location. Ideally, the adjustment would be located at the rear of the plier, readily accessible to the user.

BRIEF SUMMARY OF THE INVENTION

The present invention is directed to an apparatus for providing a self adjusting closure mechanism for a locking plier or similar device. Central to the invention are a set of one or more friction pawls which slide along a support rod, moved by a push link working against a spring. The push link is free to rotate between two positions relative to the rod, as it slides. In the first position, and in between, the push link bears against the center of the friction pawls-and they remain free to slide along the rod. When the push link rotates to the second position, it presses on the edge of the pawls, causing them to tilt, coupling to the rod and preventing movement along the rod. In a typical locking plier, the support rod is mounted to the frame and the opposite end of the push link connects to the handle. As the handle closes, the push link rotates towards its second position and optionally slides along the support rod. When the friction pawls lock, the plier begins to grip and lock on to the work piece.

According to an aspect of the invention there is provided a means of adjusting the relative angle of the second position of the push link when the pawls lock. Preferably this is in the form of a circular wedge, or helix which fits in between the push link and the pawls. Ideally, this helix is coupled to the support rod so that it slides along with the push link and pawls, but rotates along with the support rod, independently of the link and pawls. This allows the grip force of the locking plier to be adjusted by rotating the support rod. Preferably, an adjusting knob, connected to the support rod extends to the rear of the plier for easy access.

Normally, the friction pawls will unlock from the support rod when released by the push link, with the assistance of the spring. According to another aspect of the invention the push link may incorporate a contact point on the side opposite from that which locks the paws to positively unlock the pawls by tilting them back to their unlocked position.

Further in accordance with the invention the force applied by the spring to the friction pawls may be adjustable. This provides a means of varying the normal position of the push link and pawls along the length of the support rod. In turn, this varies the width of the plier jaws in their normal, open position.

The advantages of such an apparatus are a self adjusting mechanism which automatically locks at a repeatable angle between the push link and rod. When used with a typical locking plier, this translates to the handle always locking at the same relative position. The plier self adjusts to the size of the work piece because when the jaws contact the work piece, the push link slides along the support rod until the angular position where the pawls lock to the rod is reached. The distance the push link moves along the rod varies with the size of the work piece, but the angle of the push link, and the handle, when the pawls lock, is substantially always the same. The adjustment varies this angle slightly allowing the grip force of the plier to be adjusted by the user.

The above and other features and advantages of the present invention will become more clear from the detailed description of a specific illustrative embodiment thereof, presented below in conjunction with the accompanying drawings.

DETAILED DESCRIPTION OF THE INVENTION

Figure 37:
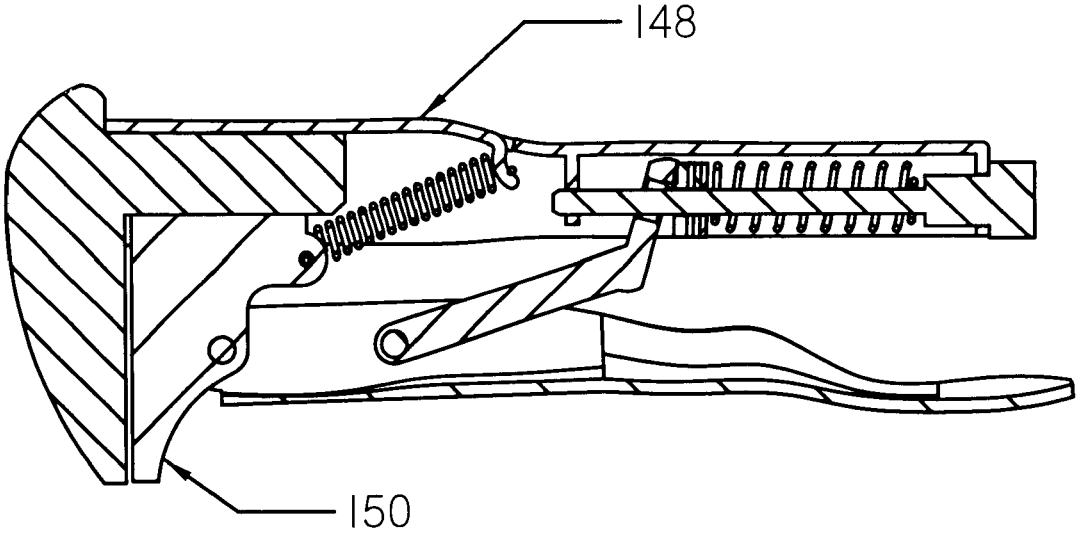
FIG. 37 is a cross section through a sliding jaw wrench taken in a plane corresponding to that of FIG. 1.

The following discussion focuses on the preferred embodiment of the invention, in which a self adjusting, variable grip force mechanism is fitted to an otherwise conventional locking plier. However, as will be recognized by those skilled in the art, the disclosed method and apparatus are applicable to a wide variety of situations in which a self adjusting locking mechanism is desired. These might include a workpiece fixture, vise, or wrench, such as illustrated in FIG. 37.

Glossary

The following is a brief glossary of terms used herein. The supplied definitions are applicable throughout this specification and the claims unless the term is clearly used in another manner.

Adjusting Knob—accessible portion of, or part attached to, the D-rod used to rotate the D-rod thereby adjusting the gripping force of the plier Back Spring—compression spring bearing on the friction pawls, urging them toward the D-pawl, preferably encircles the D-rod.

D-pawl—element contacted by the push link, transferring the force to the friction pawls. Engages the D-rod so that rotating the D-rod, via the adjusting knob, rotates the D-pawl. In the preferred embodiment, the engagement is via a D-shaped opening which receives the D-rod. Other mechanisms could also be used.

D-rod—support rod upon which the D-pawl and friction pawls ride. In the preferred embodiment, the D-rod is D-shaped for engagement of the D-pawl. Other shapes and/or mechanisms could be used. Where the grip force adjustment is not used, the rod may be round or any other desired profile.

Easy open lever—lever attached to the handle which pushes on the push link to provide a means to open the plier with reduced force.

Forward, Rearward—generally, forward is toward the jaw end of the plier and rearward is toward the handle end of the plier.

Frame—fixed grip portion of the plier attached to the fixed jaw and carrying the D-rod and adjusting knob.

Friction pawls—one or more plates which ride on the D-rod and when cammed by the push link via the D-pawl, couple to the D-rod.

Handle—movable grip portion of the plier, rotatably coupled to the movable jaw and the push link.

Locking Tool—any tool such as a plier, wrench or vise which grips a work piece, and then holds the work piece without requiring continuing pressure from the user.

Main Spring—tension spring which pulls the movable jaw rearward to open the plier.

Jaws—opposing elements which grip the work piece.

Push Link—preferably dog leg shaped element coupling the handle to the D-rod. Slides on the D-rod until the friction pawl(s) lock onto the D-rod.

Preferred Embodiment

The disclosed invention is described below with reference to the accompanying figures in which like reference numbers designate like parts.

Overview

The present invention is a self adjusting, variable grip strength closure mechanism for a locking plier or similar tool. It is described herein primarily with reference to an otherwise conventional locking plier. Much of that part of the structure of the plier which is not associated with the self adjusting or variable grip strength functions is much the same as that of a conventional locking plier. The frame, 102, serves as the fixed portion of the grips and is solidly attached to the fixed jaw, 104. The movable jaw, 106, is rotatably coupled to the frame and moves between open and closed positions relative to the fixed jaw. The handle, 108, moves inward and outward to close and open the plier respectively. It is rotatably coupled to the movable jaw and the push link, 116. When the push link locks to the D-rod (discussed below) the handle pushes forward on the movable jaw to apply gripping force to the work piece. The handle is held in a closed position by the over-center action of the connection to the push link relative to the connection to the movable jaw. The easy open lever, 110, pushes the handle outward, approximately to the on-center position of this relationship to ease the task of opening the handle.

The novelty in the present invention resides in the self adjusting mechanism which causes the plier to lock with substantially the same force on any size work piece (assuming no change to the force adjustment) and in the force adjustment mechanism which regulates the amount of gripping force applied to the work piece without regard to the size of the work piece. These functions and the apparatus which implements them will be described in more detail below.

Structure

Central to self adjusting mechanism is the push link, 116, the preferred embodiment of which is detailed in FIGS. 13–16 and a first alternative embodiment in FIGS. 29–32. The push link connects the handle, 108 to the D-rod, 114, which in turn connects to the frame. It is the push link which applies a forward force to the handle, and through it to the movable jaw, 106, causing the jaw to, close. It is also the push link which controls the locking sequence as the friction pawls shift from being free to slide along the D-rod to being coupled to the D-rod and unable to move.

In the preferred embodiment, the push link has a generally "dog leg" shape with the longer arm, 117, connecting to the handle. The relative angle of the two segments and their length is determined by the specific application and especially by the distance and angle to the point of connection with the handle from the D-rod. The first alternative embodiment, 144 in FIGS. 29–32 is a minimal design having only the essential elements. For clarity, the locking sequence is illustrated in FIGS. 7–12 with a second alternative embodiment of the push link, 146 in FIGS. 33–36, having no ramp, and with no D-pawl and having physical planes to represent the critical relationships. As illustrated, and as discussed below, the locking mechanism is not dependant upon the force adjustment provided by the ramp and D-pawl.

Referring to FIGS. 7–12, a simplified embodiment of the push link is used to illustrate the locking sequence. A single friction pawl is also used for clarity. It should be understood that this single pawl behaves in the same manner as the stack of plural pawls used in the preferred embodiment. Refer to FIGS. 33–36 for details of the push link. The most important features of the push link are the ridge, 130, where the push link contacts the adjacent pawl, 120, throughout its range of motion and the tip, 122, where it makes contact to lock the pawl. Plane 132 intersects these two points while plane 134 intersects the ridge and extends substantially perpendicular to the D-rod in the starting position of FIG. 7.

The angle of plane 132 in its starting position relative to the face of the adjacent pawl determines the angle through which the push link can rotate before the pawls begin to lock. More precisely the critical relationship is the difference between the angle of plane 132 in its unlocked position, i.e. FIG. 7, and its angle when the friction pawls lock against the D-rod, i.e. FIG. 9. This will be seen more clearly as the locking sequence is discussed below.

Figure 7:
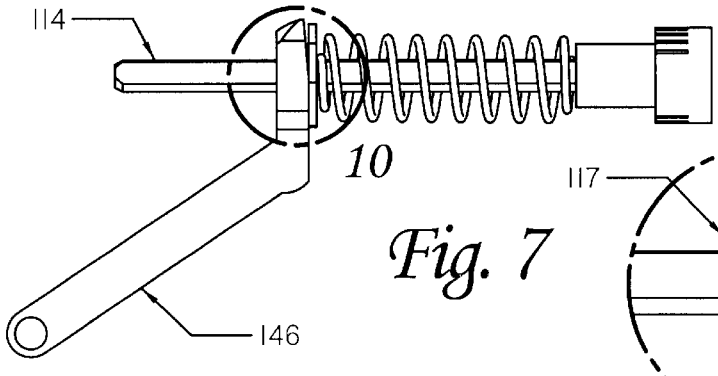
FIG. 7 illustrates a simplified version of the adjusting mechanism in its fully open position.
Figure 10:
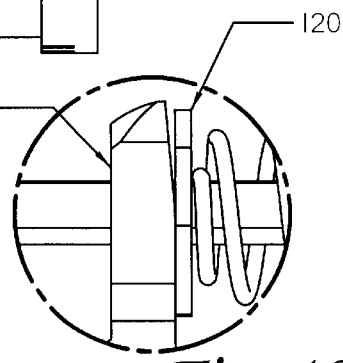
FIG. 10 is a detailed view of FIG. 7.

The orientation of plane 134 is most important while the plier is open and while beginning to close. As shown in FIGS. 7 and 10, the relative angle between plane, 134, and the longitudinal axis of the D-rod, 114, with the plier fully open, should be no more than 90 degrees and would preferably be slightly less. The reason for this angle is to prevent the push link, 146, from tilting the friction pawl, 120, relative to the D-rod, opposite to its normal locking angle and causing it to lock at a reverse angle. This would prevent the pawl and the push link from sliding freely on the D-rod which is important to the self adjusting process. While the mechanism would likely operate if the plane were to move slightly past the 90 degree point, the chance of the pawl accidentally locking increases. With the angle less than 90 degrees, the push link will bear against the pawl at the ridge, 130, which is approximately centered on the D-rod. With the back spring applying uniformly distributed pressure against the back of the friction pawl, it will then remain substantially orthogonal to the D-rod throughout the initial motion. In the preferred embodiment, the back spring is formed with a reduced diameter coil immediately adjacent to the friction pawl. This keeps the spring's force near the center of the friction pawl which further assists in retaining the orthogonal position of the pawl.

Conceptually, plane 134 is a boundary on the push link. As long as no part of the push link extends beyond this plane in the area where it would contact the adjacent pawl, the mechanism will function as designed. Note that there is no necessity that plane 134 be physically present in the link, as illustrated in the alternative embodiment, 144, of FIGS. 29–32. While this form may not be practical in the preferred embodiment, due to the configuration of the plier, (Note that it will not make contact with the easy open lever, 110.) it would be functional in a different design or application. The physical presence of plane, 134, may be advantageous however-in that when the plier is opened, this plane may contact the opposite edge of the pawls assisting them in unlocking from the D-rod.

Figure 1:
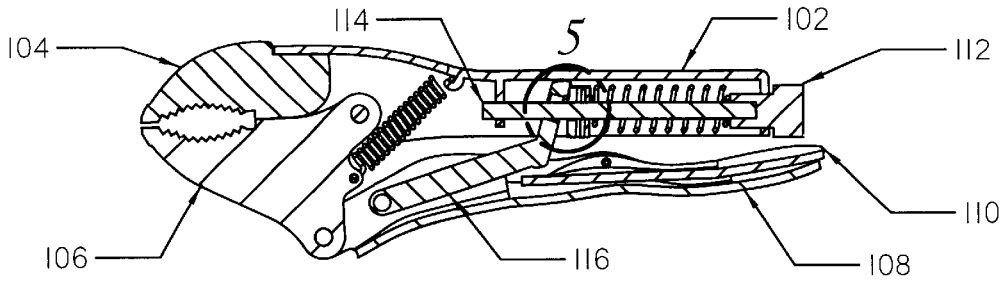
FIG. 1 is a vertical cross section through a typical locking plier fitted with the inventive adjusting mechanism.
Figure 2:
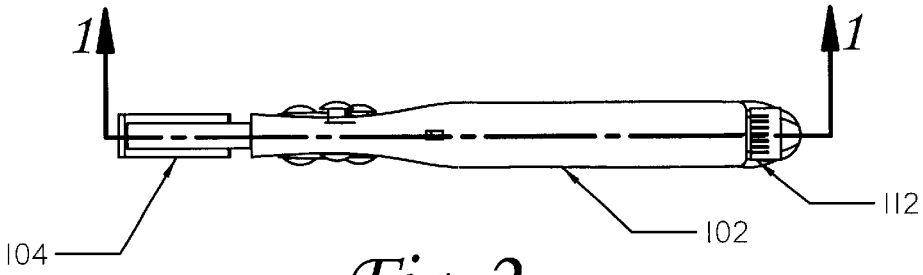
FIG. 2 is a top view of the plier of FIG. 1.
Figure 3:
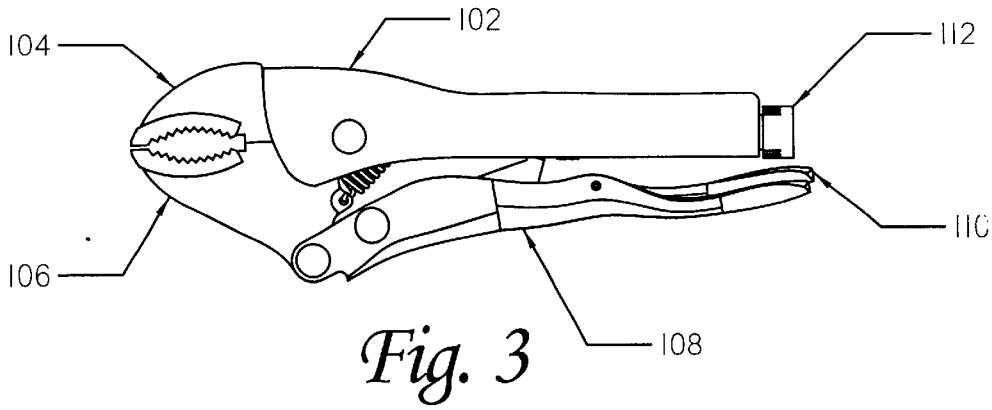
FIG. 3 is a front view of the plier of FIG. 1.
Figure 4:
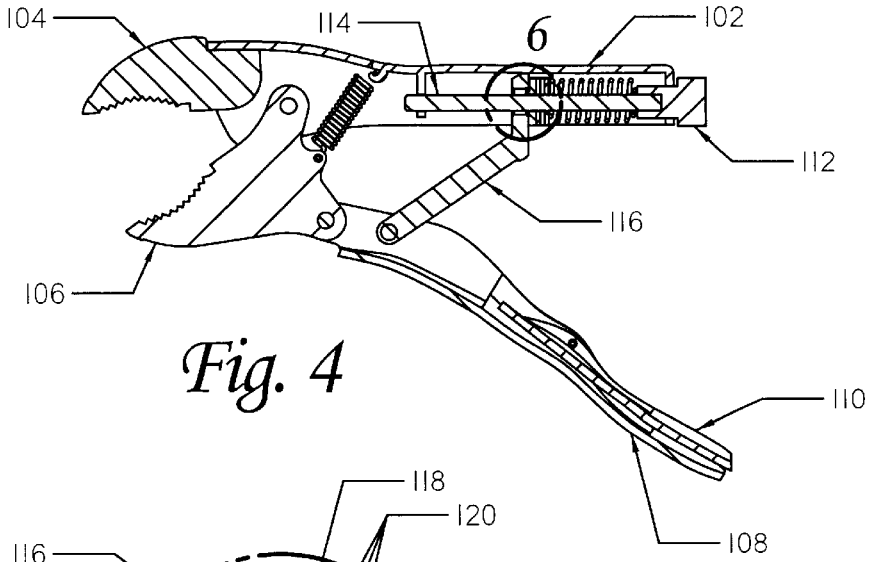
FIG. 4 is a cross section of the plier of FIG. 1, in the same plane, with the plier in an open position.
Figure 5:
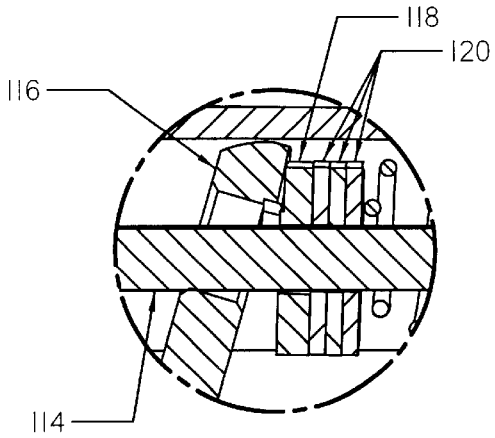
FIG. 5 is a detailed view of the adjusting mechanism when the plier is closed.
Figure 6:
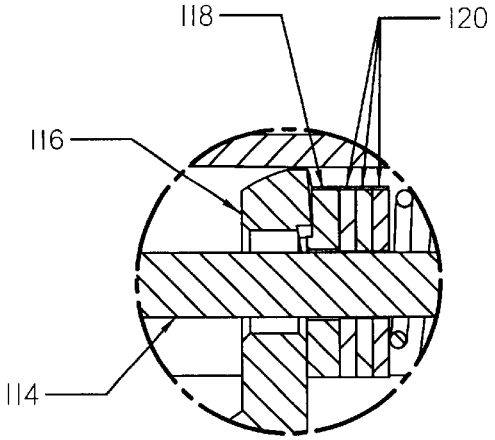
FIG. 6 is a detailed view of the adjusting mechanism when the plier is open.
Figure 8:
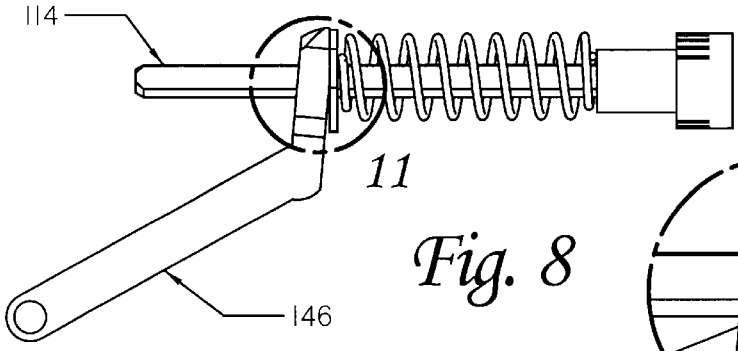
FIG. 8 illustrates the simplified version of the adjusting mechanism as the tip of the push link first makes contact with the friction pawl.
Figure 11:
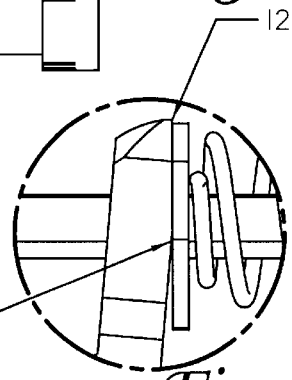
FIG. 11 is a detailed view of FIG. 8.
Figure 9:
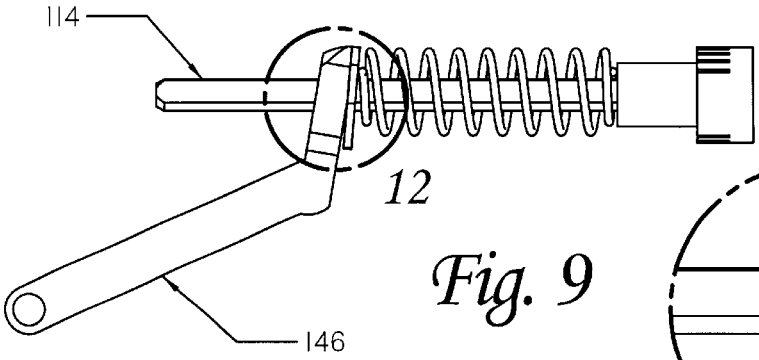
FIG. 9 illustrates a simplified version of the adjusting mechanism with the pawl locked against the rod.
Figure 12:
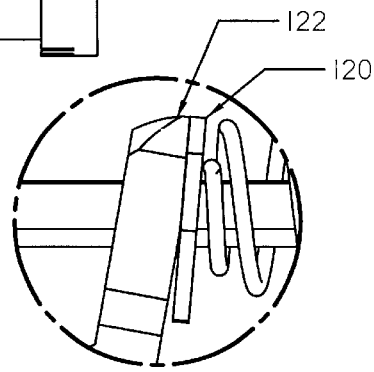
FIG. 12 is a detailed view of FIG. 9.
Figure 13:
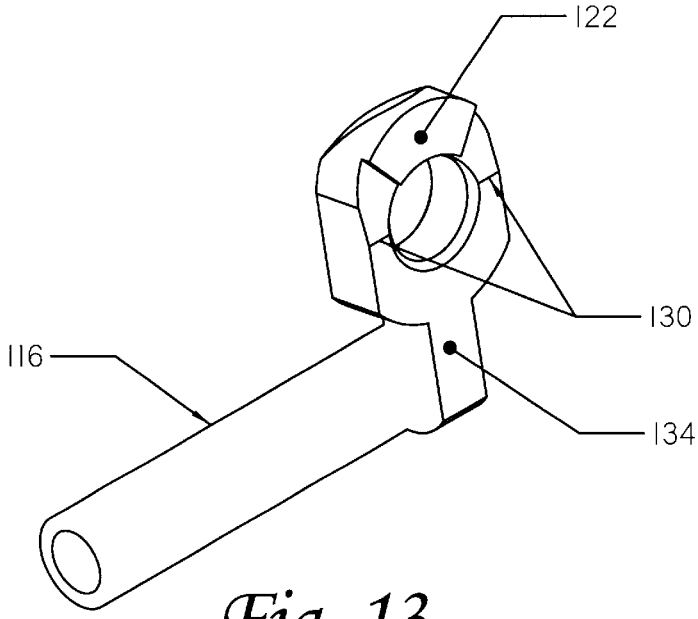
FIG. 13 is a perspective view of the preferred embodiment of the push link.
Figure 14:
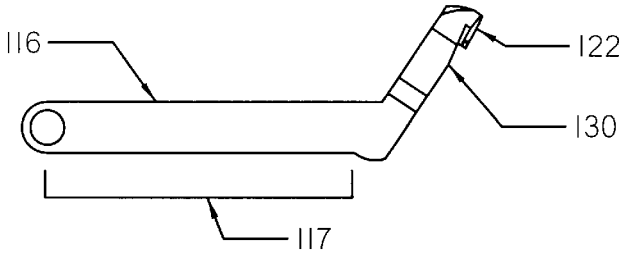
FIG. 14 is a front view of the preferred embodiment of the push link.
Figure 15:
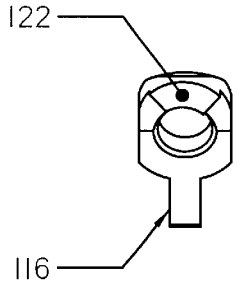
FIG. 15 is a side view of the preferred embodiment of the push link.
Figure 16:
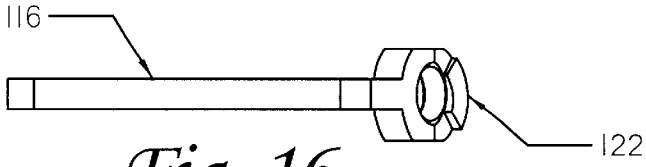
FIG. 16 is a bottom view of the preferred embodiment of the push link.

The angle of plane 132 comes into play as the plier begins to lock. Referring to FIGS. 8 & 11, it can be seen that as the handle, 108, is squeezed and the plier begins to close, the push link, 116 begins to rotate relative to the D-rod and pawl, pivoting at the ridge, 130, closing the gap between plane 132 and the friction pawl. As illustrated, the pawl remains orthogonal to the D-rod up to the point that plane, 132, and most importantly the tip, 122, of the push link, makes contact with the face of the pawl. Once this contact is made, further rotational movement of the push link causes the pawl to begin to tilt, see FIGS. 9 and 12. When the friction pawl has tilted far enough that the edges of their central holes contact the D-rod, see FIG. 5, it locks in place, preventing rearward movement of the push link. Additional movement of the push link will cause it to break contact with the pawl at the ridge and to bear on the pawl solely at the tip of the link and the edge of the pawl.

Because the locking of the friction pawl is triggered by the relative angle of plane 132 to the D-rod, the locking of the friction pawls always occurs at substantially the same relative angle between the push link and the D-rod, regardless of the position of the movable jaw. Because of the push link's connection to the handle, this implies that the handle will always be at substantially the same angle relative to the frame when the pawls lock This principle is what makes the plier self adjusting. If the movable jaw encounters a work piece before the push link achieves this angle, it and the pawl are free to slide rearward until the angle is met and the friction pawl locks.

While the relative angles of plane 132 is important, it should be noted that no specific angle is required. The exact angle will depend on a number of factors including size and point of connection between the various parts. It should also be recognized that the planes need not exist as physical aspects of the push link. All that is necessary is that there be a ridge, substantially perpendicular to the rod which can function as a pivot for the pawls and a point of contact preferably at the tip of the push link. This is illustrated by the alternative embodiment of FIGS. 29–32. Plane, 132, intersects the ridge and the point of contact with the adjacent pawl. What is important is that the behavior described herein is achieved. The primary criteria for the angle of plane, 134, is that the pawls remain free to slide on the D-rod when the plier is fully open. The primary criteria for the angle of plane, 132, is the desired angle of the push link, and thus the handle to which it is attached when locking occurs.

Throughout the locking sequence, the outer surface of the tip of the push link preferably rides against the inner surface of the frame. The edges of the hole through the push link, through which the D-rod passes, make only incidental, if any, contact with the D-rod. This is to prevent the push link from coupling to the D-rod when its tip bears against the edge of the adjacent pawl. While this arrangement is preferred, it is anticipated that an operable mechanism could be developed in which the push link rides on the D-rod and such an approach would be considered equivalent.

The mechanical advantage of the friction pawls is increased by increasing the distance from the point at which the edge of their central opening contacts the D-rod and the point at which the first pawl contacts the tip of the push link. Increasing this distance, within reason, will improve the locking action of the friction pawls.

While the configuration of the push link is central to the self adjusting feature, it works in concert with other elements to achieve optimal functionality. Main spring, 124, and back spring, 126, are matched such that the resistance of the back spring against the pawls is sufficient to prevent rearward movement of the push link when the plier is closing against only the force of the main spring. This causes the movable jaw to close against the work piece when the handle initially begins to close. At that point, the back spring begins to compress, allowing the push link to move rearward as the handle continues to close. Throughout both phases of closing, the push link is rotating, as described above, toward the angle at which its tip will contact the D-pawl and lock the friction pawls against the D-rod. Because this rotational movement occurs during both phases of closing, the plier will lock at substantially the same handle position without regard to when the movable jaw contacts the workpiece. The only difference is how far rearward the push link will move before locking occurs.

The relative position of the push link at the point of equilibrium between the main spring and the back spring provides the normal open position of the plier components. If this position is too far rearward, the plier may not close fully by normal operation of the handles. If too far forward, the jaws will not fit easily over a large work piece. It should be noted, however, that with the plier open, the jaws can be pushed over a larger workpiece than will fit the jaws in their normal open position. Doing so merely forces the push link rearward, compressing the back spring. The plier can then,be closed normally and will lock as described above.

In a typical locking plier, such as illustrated, when the movable jaw is forced to open extra wide, its point of connection to the handle begins to move back toward the frame. This movement causes the push link to angle slightly toward the locking position. As a result, an oversized object may be gripped with greater force than an object in the normal range of size due to the friction pawls locking somewhat earlier. If desired, this may be compensated for by tapering the D-rod toward the rear, in the region in which locking would occur for an oversized object. In practice a taper where the rear end of the rod is approximately 0.003" smaller than the front end has been found effective.

It should also be noted that in the preferred embodiment the push link is attached to the handle, 108. This is not critical to the invention. While this arrangement is central to the locking aspect of the plier, via the over center relationship of the two points at which the handle connects to the push link and the movable jaw, it is not critical to the self adjusting feature, which could be adapted to other, possibly non-locking plier designs.

As described above, the plier will always begin to lock at the same handle position and will thus always apply the same force to the work piece. Were no adjustment needed, the D-pawl could be eliminated and the push link could bear directly on the forward most friction pawl, as discussed. However, grip force adjustment is generally desirable and this is provided in the present invention by the interaction of the D-pawl and the push link.

Figure 17:
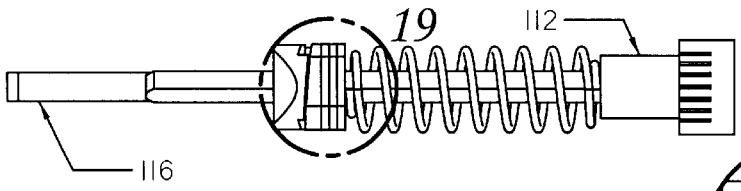
FIG. 17 is a top view of the preferred embodiment of the adjustment mechanism with the D-pawl adjusted for the highest gripping force.
Figure 19:
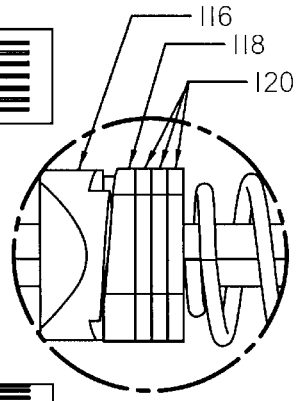
FIG. 19 is a detailed view of FIG. 17
Figure 18:
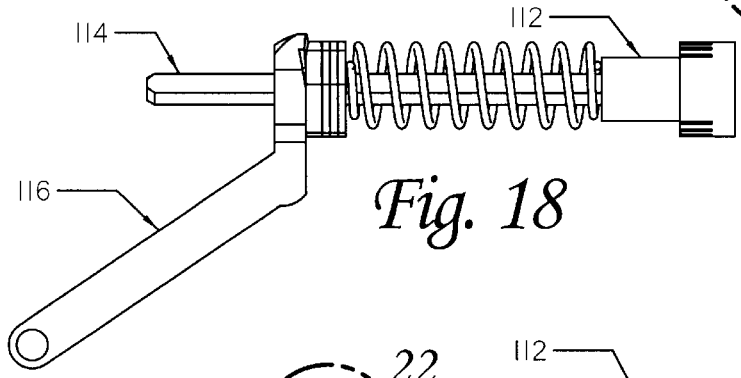
FIG. 18 is a front view of the preferred embodiment of the adjustment mechanism as illustrated in FIG. 17.
Figure 20:
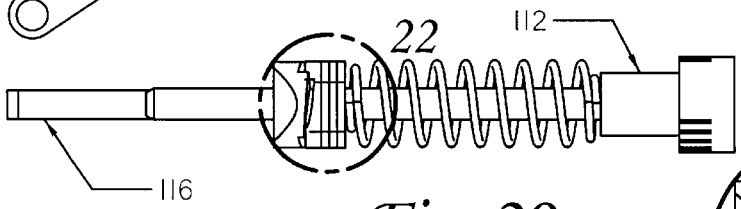
FIG. 20 is a top view of the preferred embodiment of the adjustment mechanism with the D-pawl adjusted for the lowest gripping force.
Figure 22:
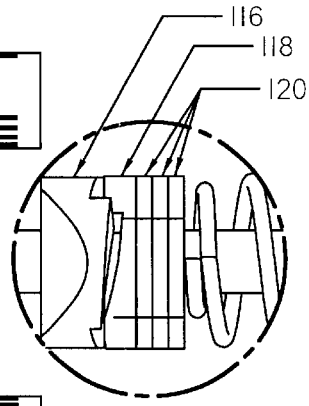
FIG. 22 is a detailed view of FIG. 20.
Figure 21:
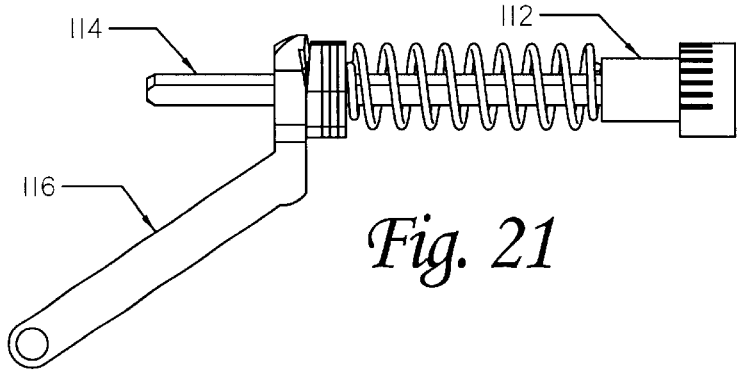
FIG. 21 is a front view of the preferred embodiment of the adjustment mechanism as illustrated in FIG. 20.
Figure 23:
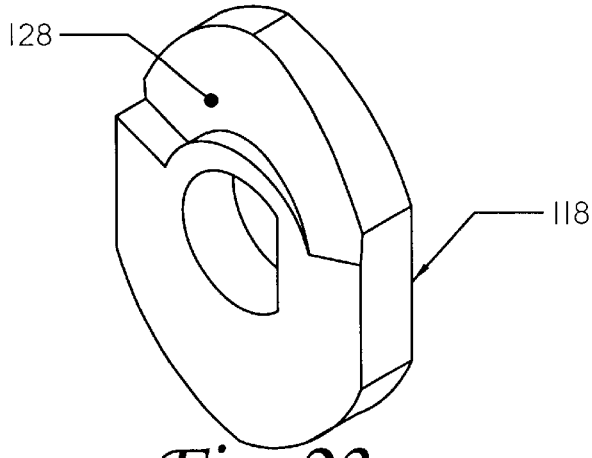
FIG. 23 is a perspective view of the preferred embodiment of the D-pawl.
Figure 24:
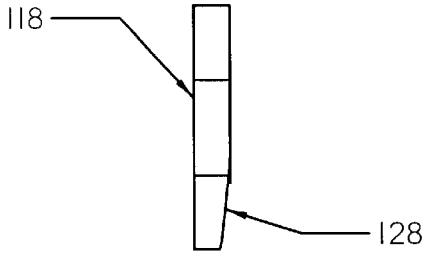
FIG. 24 is a side view of the preferred embodiment of the D-pawl.
Figure 25:
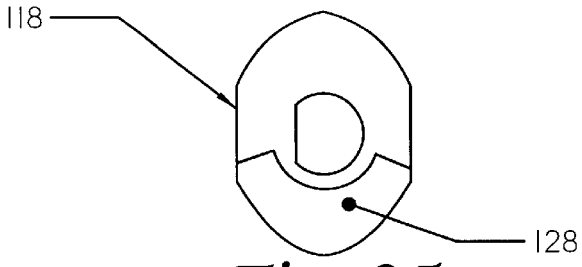
FIG. 25 is a front view of the preferred embodiment of the D-pawl.
Figure 26:
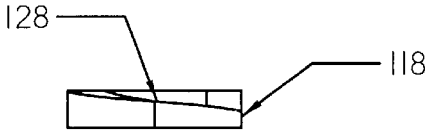
FIG. 26 is a bottom view of the preferred embodiment of the D-pawl.

As detailed in FIGS. 23–26, the D-pawl, 118, incorporates a ramp, 128, in the area where the D-pawl is contacted by the tip of the push link, 116. This corresponds to the angled tip, 122, of the push link as illustrated in FIGS. 13–16. As FIGS. 17–22 illustrate, rotating the D-pawl relative to the push link varies the height of the ramp at the point of contact which has the effect of varying the gap between the push link and the D-pawl when the plier is open. This gap represents slack which must be taken up before the pawls will begin to tilt. FIGS. 17–19 show the D-pawl rotated to its highest ramp position. In this position, the tip of the push link will contact the D-pawl sooner in its range of movement, thus causing the friction pawls to lock sooner. FIGS. 20–22 show the D-pawl rotated to its lowest ramp position. In this position, a greater angular movement of the push link will be required to bring the tip of the link into contact with the D-pawl, delaying the locking of the friction pawls. The earlier the friction pawls lock, the further away from the frame the handle will be. The amount of handle movement occurring after the friction pawls lock determines the gripping force applied to the workpiece. This corresponds substantially to the action of a conventional locking plier where this position is adjusted directly.

Rotation of the D-pawl, for purposes of adjustment, is achieved through a rotational coupling to the D-rod; 114. In the preferred embodiment, the D-rod has a D-shaped cross section and the D-pawl has a matching D-shaped opening therethrough. The fit is sufficiently loose that the D-pawl can slide and pivot slightly on the D-rod but tight enough that the D-pawl will rotate in concert with the D-rod. Clearly other shapes or mechanism could be used to achieve the same result. Adjustment knob, 112, protrudes through the rear of the frame, 102, accessible to the user. The adjusting knob can be clamped to the D-rod with a set screw, pinned, welded, or attached in any other manner. If desired, it could even be formed integrally with the D-rod. Preferably the knob will be knurled for improved grip. Also preferably, the knob will have a series of index marks to indicate the position of the knob and thus the relative grip force of the plier. These marks align with one or more marks on the frame of the plier and may be formed by scribing, stamping, or other appropriate method. In the preferred embodiment, two sets of marks are provided on opposing sides of the knob, along with a pair of matching marks on the frame. This allows the user to see the marks with the plier in either an upright or inverted position.

It should be noted that in the preferred embodiment the ramp, 128, on the D-pawl, 118, is formed as a helix. The tip, 122, of the push link, 116, is also formed as a matching helix. This provides the maximum amount of contact between these two parts, reducing wear and increasing life. While preferred, these shapes are not critical. A push link with a flat or rounded tip, see FIG. 29, in combination with a D-pawl having a straight, planar taper across the pawl, for example, would achieve the same behavior as describe above although performance would be expected to be inferior.

In the preferred embodiment, the full range of adjustment occurs within approximately 40 degrees of movement. In part this is for user convenience and in part so that the pawls can be made oblong to increase their leverage without having to increase the width of the frame. The amount of height adjustment provided in the ramp will depend on the relative lengths and angles of the other parts, but in all cases will be relatively small. In the preferred embodiment the difference in thickness between the two ends of the ramp is approximately 0.04".

The D-rod, 114, takes the full rearward force of the push link, 116, when the plier locks closed. This force must be transferred to the frame of the plier while allowing the D-rod to freely rotate. In the preferred embodiment, this is accomplished by threading the adjusting knob, 112, into the rear of the frame. The D-rod is then received by the adjusting knob. The slight lengthwise movement of the D-rod caused by the threads when the adjusting knob is moved has no effect because the D-pawl is free to move along the D-rod. Clearly other methods of retaining the D-rod in the plier would be applicable and are anticipated. As an example, the D-rod could be formed with an integral shoulder which bears against the inner surface of the rear of the frame. It could also be retained by a set screw, pin, spring clip or other means. Preferably the D-rod is aligned substantially parallel to the region of the frame in which it is positioned. If preferred, it can be angled slightly with the forward end positioned slightly toward the handle. This has no impact on functionality and provides slightly more clearance around the D-rod at the forward end. This clearance may make it easier to fit the push link or allow the end of the push link, or the pawls, to be slightly larger.

The engagement between the D-rod and the friction pawls is important to the operation of the inventive adjusting mechanism. To this end, the outer surface of the D-rod, at least in the area where it contacts the friction pawls, is preferably roughened. This may be achieved by rough grinding, fine knurling, sand blasting, or other methods known in the art. This roughness becomes most important where grease, oil, or dirt enters the mechanism, interfering with the mating of the friction pawls to the D-rod. With a roughened surface, any adverse impact will be minimized.

The design of the friction pawls, 120, is relatively straight forward. They may be round, oval, or any other appropriate shape to be received within the frame of the plier. Their central opening should generally match the profile of the D-rod. In the preferred embodiment both round and D-shaped openings have been found to perform well. The edges of the central opening should be well defined, to assure a good grip against the D-rod but need not be sharp. The number of friction pawls may be varied to adapt their combined gripping power to the needs of a specific plier design. The design and use of such friction pawls is well known in the art, having been used for decades on machinists vises, storm doors and caulking guns among other applications.

Alternative Embodiments

The following discussion presents alternative embodiments which offer various advantages in structure or functions without departing from the principles of the invention.

In the preferred embodiment, index marks are scribed on the adjusting knob and on the frame to provide a visual indication of the selected gripping force. If desired, this approach may be either supplemented or replaced with a series of detents, and corresponding spring loaded pin, to provide positive stops at pre-selected grip force settings.

Figure 27:
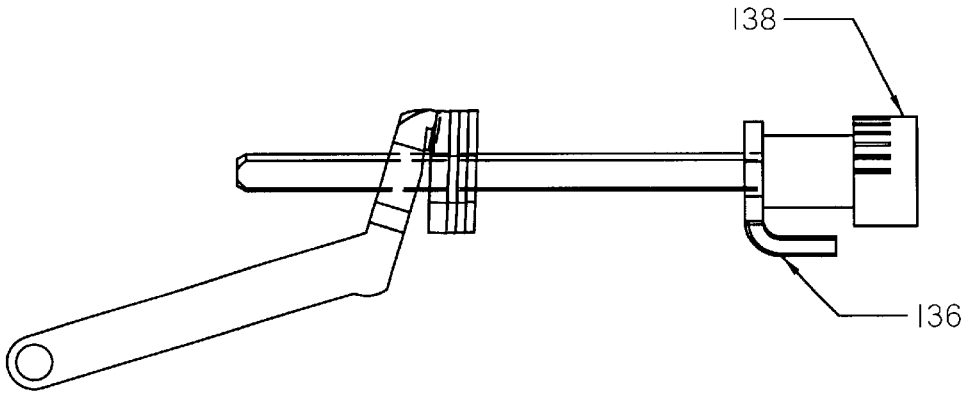
FIG. 27 illustrates a first alternative embodiment of the mechanism which provides for adjustment of the jaw opening.
Figure 28:
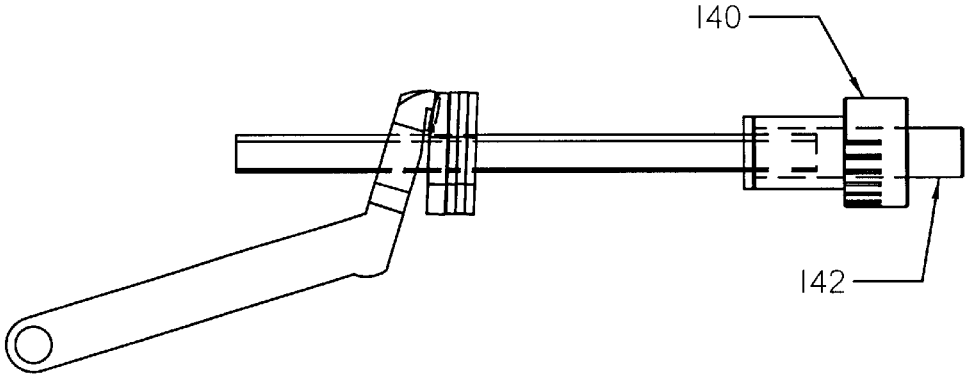
FIG. 28 illustrates a second alternative embodiment of the mechanism which provides for adjustment of the jaw opening.
Figure 29:
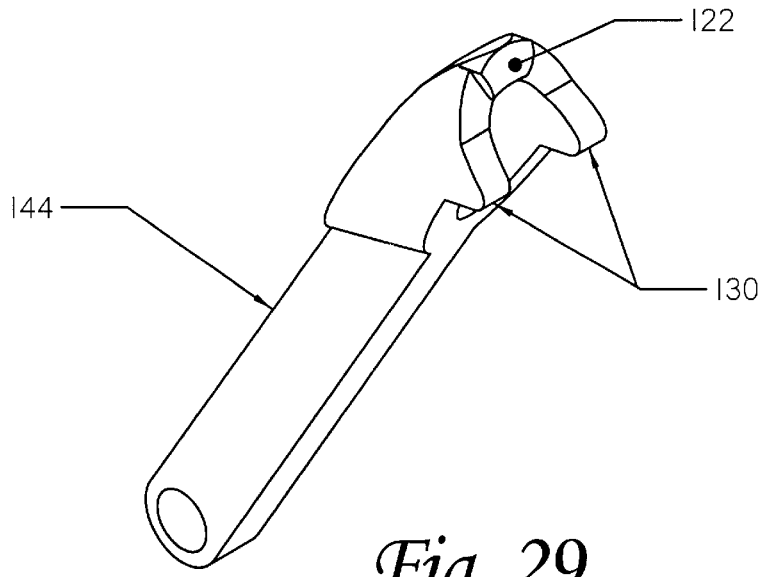
FIG. 29 is a perspective view of a first alternative embodiment of the push link.
Figure 30:
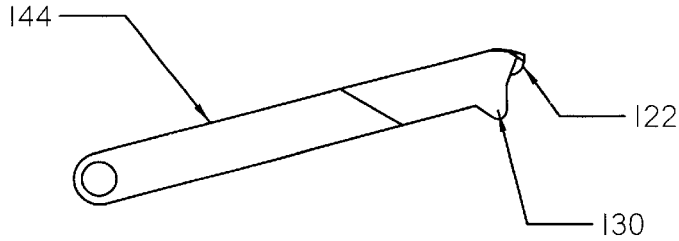
FIG. 30 is a front view of a first alternative embodiment of the push link.
Figure 31:
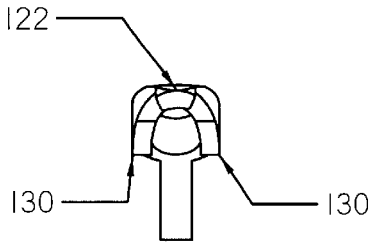
FIG. 31 is a side view of a first alternative embodiment of the push link.
Figure 32:
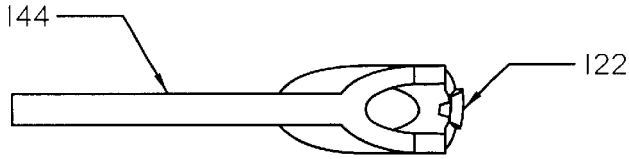
FIG. 32 is a top view of a first alternative embodiment of the push link.
Figure 33:
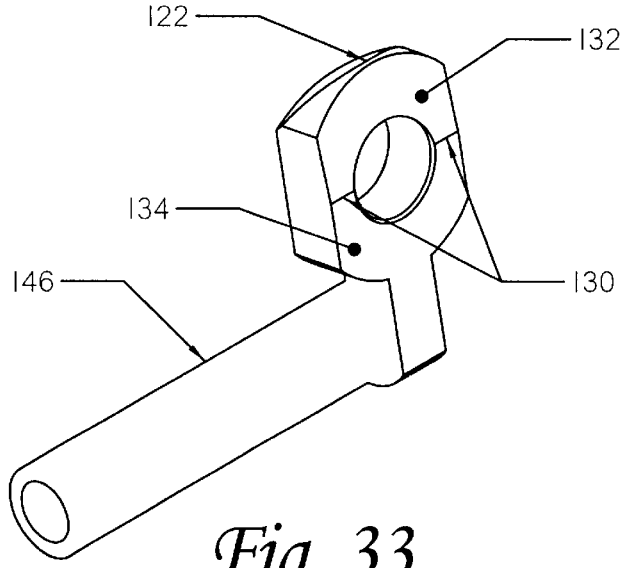
FIG. 33 is a perspective view of a second alternative embodiment of the push link.
Figure 34:
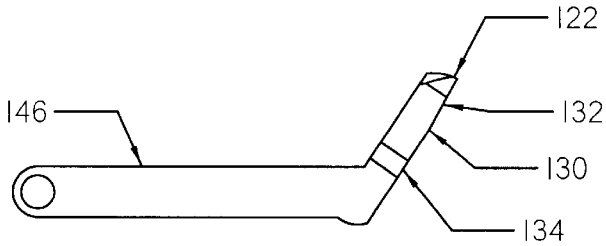
FIG. 34 is a front view of a second alternative embodiment of the push link.
Figure 35:
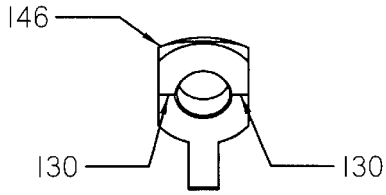
FIG. 35 is a side view of a second alternative embodiment of the push link.
Figure 36:
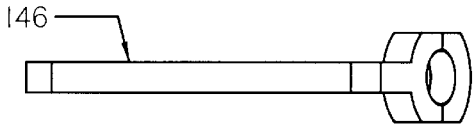
FIG. 36 is a top view of a second alternative embodiment of the push link.

As described above, the jaws of the preferred embodiment can be opened wider than their neutral position by pressing a work piece into the jaws, causing the push link and pawls to move rearward. If preferred, an adjustment can be provided to alter the neutral position of the push link and jaws. As illustrated in FIG. 27 an adjusting lever, 136, has been fitted to the D-rod, 114, at the point where it meets the adjusting knob, 112, within the cavity formed by the frame. Adjusting knob, 138, differs from that of the preferred embodiment in that it is not coupled to the D-rod, but is free to rotate freely relative to the D-rod. It does, however, received the end of the D-rod and brace it against longitudinal movement. The adjusting knob is threaded into the frame such that turning the knob will cause it to move in and out relative to the frame. Since the back spring, 126, bears against the adjusting lever, which bears against the front of the adjusting knob, moving the knob in and out alters the length of the back spring. This in turn alters the neutral point of the push link as the back spring and main spring seek a new neutral position. The adjustment lever is coupled to the D-rod such that rotating the lever causes the D-rod to rotate, adjusting the position of the. D-pawl, 118, as described in the preferred embodiment. Preferably the adjusting lever protrudes somewhat above the frame for easy access but not so far as to interfere with the handle or the remainder of the locking mechanism. A similar approach is illustrated in FIG. 28 except that the grip force adjustment is performed by knob, 140, which extends through the opening in size adjustment knob, 140. Clearly other means of providing both grip force and opening size adjustment are also possible using the inventive self adjusting mechanism with grip force adjustment.

FIG. 37 illustrates an alternative embodiment, 148, in which the inventive mechanism has been fitted to a sliding jaw wrench rather than a plier. The principle of operation is the same. The sliding jaw, 150, of the wrench will close in concert with the closing of the movable handle until it contacts a work piece. The jaw will then stop and the push link will slide rearward until the pawls lock to the D-rod. The jaws will then clamp to the work piece.

While the preferred form of the invention has been disclosed above, alternative methods of practicing the invention are readily apparent to the skilled practitioner. The above description of the preferred embodiment is intended to be illustrative only and not to limit the scope of the invention.

We claim:

1. In a locking tool comprising a frame, fixed jaw fixedly attached to the frame, movable jaw movably attached to the frame, and a handle pivotally attached to movable jaw, where moving the handle toward the frame causes the movable jaw to move toward the fixed jaw, a self adjusting closure apparatus comprising:

a) an extended support rod, mounted to the frame, said support rod having a longitudinal axis;

b) a push link pivotally coupled to the handle at a first end and having an opening defined through the second, opposite end, said opening receiving said support rod, said push link having a ridge approximately aligned with and perpendicular to said support rod axis, whereby moving the handle toward the frame causes said push link to rotate between first and second positions, said positions defined in terms of the angle of said push link relative to said support rod;

c) at least one friction pawl, adjacent to said push link, having an opening defined therethrough receiving said support rod;

d) a back spring, bearing against said at least one friction pawl, urging it into contact with said push link at said ridge;

wherein when said push link is in said first position it contacts said at least one friction pawl solely at said ridge, said at least one friction pawl is maintained substantially orthogonal to said support rod axis by the action of said back spring, and said at least one friction pawl and said push link are free to move linearly along said support rod;

wherein when said push link is in said second position it contacts said at least one friction pawl at a first point offset from said support rod axis, causing said at least one friction pawl to tilt relative to said support rod, the edges of said opening in said at least one friction pawl contacting and coupling to said support rod whereby linear movement of said pawl and said push link are blocked in at least one direction; and wherein if the movable jaw contacts a workpiece prior to said push link reaches said second position, said second end of said push link and said at least one friction pawl slide along said support rod, compressing said spring, until said push link reaches said second position.

2. The self adjusting closure apparatus of claim 1 wherein the tool further comprises a main spring urging said movable jaw open and said push link rearward against said at least one friction pawl and wherein the force of said back spring against said at least one friction pawl is adjustable to offset the force of the main spring whereby the linear position of said push link and said at least one friction pawl relative to said support rod can be adjusted.

3. The self adjusting closure apparatus of claim 1 wherein said second end of said push link bears against the frame.

4. The self adjusting apparatus of claim 1 wherein when said push link is in said first position it contacts said at least one friction pawl at a second point, opposite from said first point relative to said support rod axis, urging said at least one friction pawl to return to said substantially orthogonal position.

5. The self adjusting apparatus of claim 1 further comprising a means of adjusting the relative angle between said push link and said at least one friction pawl when said push link is in said second position whereby the grip force applied by the tool to a work piece is adjusted.

6. The self adjusting of apparatus of claim 5 wherein said means of adjusting comprises a wedge interposed between said first point of contact and said at least one friction pawl.

7. The self adjusting apparatus of claim 6 wherein said means of adjusting comprises means for adjusting the position of said wedge relative to said push link whereby the thickness of said wedge at said second point of contact is variable.

8. The self adjusting apparatus of claim 7 wherein said support rod mounting allows rotation of said support rod about said longitudinal axis and wherein said means for adjusting the position of said wedge comprises slideably coupling said wedge to said support rod whereby rotating said support rod moves said wedge relative to said push link.

9. A self adjusting locking plier comprising:

a) a frame;

b) a fist jaw fixedly attached to said frame;

c) a second opposing jaw pivotally attached to said frame;

d) a main spring, coupling said second jaw to said frame, urging said second jaw toward an open position;

e) a handle pivotally attached to said second jaw;

f) a push link pivotally coupled to said handle at a first end and bearing against said frame at a second, opposite, end, having an opening defined through said second, end, having a transverse ridge aligned with said opening;

g) an extended support rod, mounted to the frame, and passing through said opening in said push link, said support rod having a longitudinal axis;

h) at least one friction pawl, having an opening defined therethrough receiving said support rod, positioned immediately adjacent to and rearward of said second end of said push link, i) a back spring, bearing against said at least one friction pawl, urging it in to contact with said push link at said ridge;

wherein closing said handle by moving said handle toward said frame urges said push link rearward against said back spring and said second jaw toward said first jaw;

wherein the relative strength of said main spring and said back spring are such that closing said handle causes said second jaw to move toward said first jaw until said first and second jaws close on a work piece positioned therebetween while said push link retains its linear position relative to said support rod and said push link slides rearward along said support rod after said first and second jaws close on the workpiece;

wherein closing said handle, both before and after said first and second jaws close on a work piece, causes said push link to rotate between first and second positions, said positions defined in terms of the angle of said push link relative to said support rod;

wherein when said push link is in said first position it contacts said at least one friction pawl solely at said ridge, said at least one friction pawl is maintained substantially orthogonal to said support rod axis by the action of said back spring, and said at least one friction pawl and said push link are free to move linearly along said support rod; and wherein when said push link is in said second position it contacts said at least one friction pawl at a first point offset from said support rod axis, causing said at least one friction pawl to tilt relative to said support rod, the edges of said opening in said at least one friction pawl contacting and coupling to said support rod whereby rearward movement of said at least one friction pawl and said push link are blocked, and whereby closure of said handle causes said second jaw to apply increasing force to the workpiece.

10. The self adjusting locking plier of claim 9 wherein when said push link is in said first position it contacts said at least one friction pawl at a second point, opposite from said first point relative to said support rod axis, urging said at least one friction pawl to return to said substantially orthogonal position.

11. The self adjusting plier of claim 9 further comprising a means of adjusting the relative angle between said push link and said at least one friction pawl when said push link is in said second position whereby the grip force applied by said plier to a work piece is adjusted.

12. The self adjusting apparatus of claim 12 wherein said means of adjusting comprises a wedge interposed between said first point of contact and said at least one friction pawl, the position of said wedge relative to said push link being adjustable whereby the thickness of said wedge at said second point of contact is variable.

13. The self adjusting apparatus of claim 12 wherein said support rod mounting allows rotation of said support rod about said longitudinal axis and wherein said means for adjusting comprises coupling said wedge to said support rod whereby rotating said support rod moves said wedge relative to said first point of contact, and said plier further comprises an adjusting knob, coupled to said support rod and extending rearward beyond said frame.

14. The self adjusting closure apparatus of claim 13 wherein the force of said back spring against said at least one friction pawl is adjustable to offset the force of the main spring whereby the linear position of said push link relative to said support rod, and thus the position of said second jaw, can be adjusted.

15. The self adjusting closure apparatus of claim 13 comprising at least one index mark formed on said frame and plural index marks are formed on said adjusting knob in a substantially adjacent position.

* * * * *